US005775507A

United States Patent [19]

Wood

[11] Patent Number: 5,775,507

[45] Date of Patent: Jul. 7, 1998

[54] HAIR COLORIST PALETTE

[76] Inventor: Terrill W. Wood, 2700 Charles St., Wellsburg, W. Va. 26070

[21] Appl. No.: 890,319

[22] Filed: Jul. 9, 1997

[51] Int. Cl.[6] ..... B65D 25/04

[52] U.S. Cl. ..... 206/581; 206/561; 206/564; D9/341

[58] Field of Search ..... D9/341, 348; 206/1.7–1.9, 206/81, 459.5, 561, 564, 581, 822

[56] References Cited

U.S. PATENT DOCUMENTS

| | | | |
|---|---|---|---|
| 2,828,044 | 3/1958 | Riess et al. | 206/561 |
| 4,412,618 | 11/1983 | La Conte | 206/581 |
| 4,533,051 | 8/1985 | Fleming | 206/563 |
| 4,754,883 | 7/1988 | Grzwa | 206/459.5 |
| 4,991,712 | 2/1991 | Wagner | 206/561 |
| 5,209,664 | 5/1993 | Wilcox | 206/1.8 |
| 5,234,108 | 8/1993 | Jorgensen | 206/575 |
| 5,697,512 | 12/1997 | Brickley | 206/561 |

*Primary Examiner*—Jimmy G. Foster

[57] ABSTRACT

A hair colorist palette that is triangular in shape that allows the colorist or hair stylist to conveniently have available all tools and supplies needed for a single process or for use in dimensional coloring. The hair colorist palette provides two large wells to hold different hair colors and a mixing chamber adjacent to the wells together with a round well for holding a bottle of permanent or semi-permanent hair coloring or extra liquid developer. In addition, a straight slot is provided for storing of brushes and/or squares of aluminum foil together with two small openings for the handles of additional brushes.

4 Claims, 4 Drawing Sheets

FIG. 4
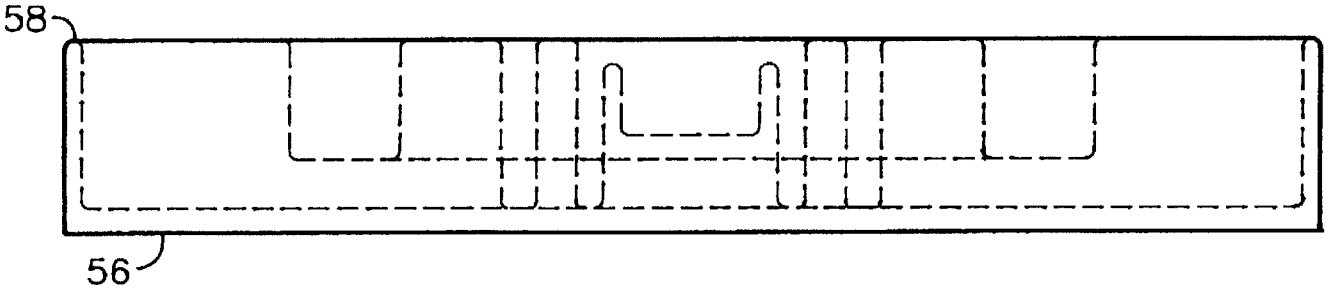
FIG. 5
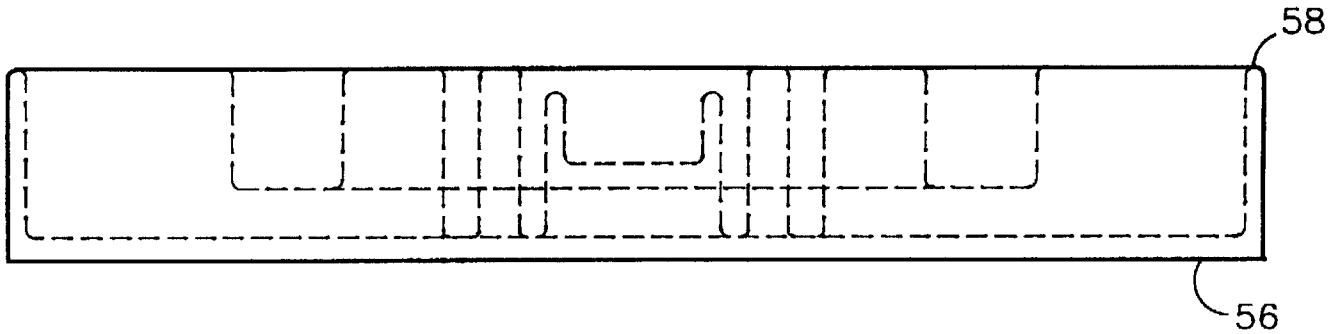
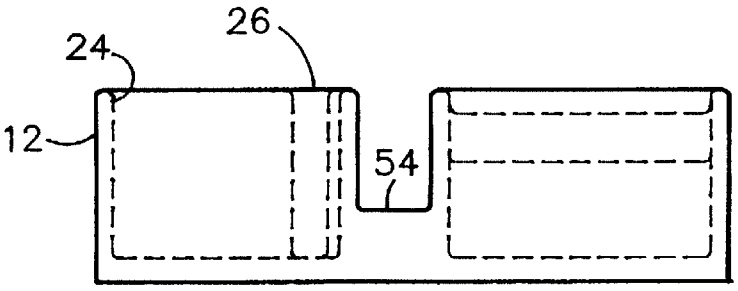
FIG. 7
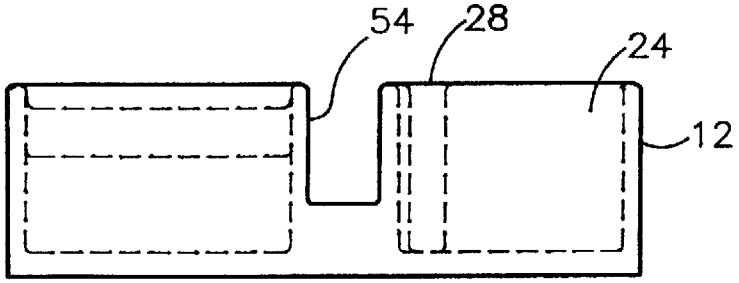
FIG. 6

HAIR COLORIST PALETTE

BACKGROUND

This invention relates to a palette for use in the hair coloring process.

The hair coloring process involves many different color processes and techniques. The tools and chemicals used in the coloring process, especially the dimensional hair coloring process, usually involves the mixing of colorants in separate dishes with the brushes typically laid out on a counter with substantial effort expended in moving from the work location (the hair) to the counter. This is a messy process.

Generally there are three color processes and with a number of variations with each one. First there is a semi-permanent color process using a color conditioner or water colors, a term used because over time, the color washes out. This technique is ideal for adding shine and usually lasts from four to six weeks.

Another technique uses a small amount of developer or peroxide which causes the color to penetrate somewhat deeper and lasts longer. This technique is particularly popular with men because the coverage isn't as heavy as a tint yet it lasts longer than a color conditioner and requires less maintenance. It is excellent for covering gray hair.

A third technique uses peroxide and provides the most coverage and lasts the longest. The chemicals provide permanent colors but are designed to be fairly gentle. The peroxide penetrates to the cortex with the permanent colors permitting shades to be either lighter or darker and can be applied in either one or two steps. The color lasts until new hair grows in.

From these three basic techniques, a trained hair colorist can create almost any appearance. All-over color can be achieved by using a semi-permanent color conditioner, a permanent one-step process or two-step process color, or henna.

The one-process color or tint is "washed over" the hair and adds warmth to dark hair and gives an overall lift to lighter hair.

The two-process color or bleach and toner first uses a lightener to remove the dark pigments from the hair, taking it to a pale blond. Then a toner is used to bring the hair to the desired shade. With the process, even dark brunettes can go blond.

Henna is made from plant leaves and stems and gives hair a ready tint. The effects range from a pale strawberry to a deep reddish black, depending upon the hairs' natural colors and the formula used. There is also a colorless kind that just adds shine.

Because henna penetrates the hair shaft, it is categorized as permanent.

Highlighting is one of the most popular techniques and creates many different looks. The strands of hair are woven with a pin comb and painted with one or several colors and then foil wrapped. The above and similar hair coloring techniques lend themselves to a variety of hair coloring. These include but are not limited to highlights that are applied just to the ends of hair, and many different foil techniques applied throughout the head with distinct colors in each foil for a spicy, "peppered" feel.

The science of corrected color not only is used to create new hairstyling, but also to correct previous mistakes.

All of the processes and techniques in the past have proven less than productive because the tools and chemicals with separate dishes for the colorants, brushes and foil have help create a messy process in carrying out the above hair coloring techniques.

SUMMARY OF THE INVENTION

The hair colorist palette has five wells and one slot. A round well is used to hold a bottle of permanent or semi-permanent hair coloring or extra liquid developer. Two small holes are used to hold brushes during the hair coloring process and are adjacent to the round well. A slot that runs through the palette holds two brushes during storage and pieces (usually squares) of aluminum foil for use during the coloring process. Two elongated deep wells are provided, one on each side of a mixing chamber. These are used to hold two different colors as well as the bleach for highlighting and other coloring products, especially in the dimensional coloring process. The hair colors from these two elongated wells as well as the hair color held in a bottle in the round well are mixed in the shallow mixing chamber until the desired composition is reached.

The features, objects and advantages of the invention will become apparent to those skilled in the art from the following detailed description of a preferred embodiment, especially when considered in conjunction with the accompanying drawings in which like numerals in the several views refer to the corresponding parts.

DESCRIPTION OF THE DRAWINGS

FIG. 4 is a front view of FIG. 2 with dotted lines showing the interior thereof.

FIG. 5 is a rear view of FIG. 2 with dotted lines showing the inside thereof.

FIG. 6 is an elevational view showing the right side of FIG. 2.

FIG. 7 is an elevational view showing the left side of FIG. 2.

DETAILED DESCRIPTION OF THE PREFERRED EMBODIMENT

Figure 1:
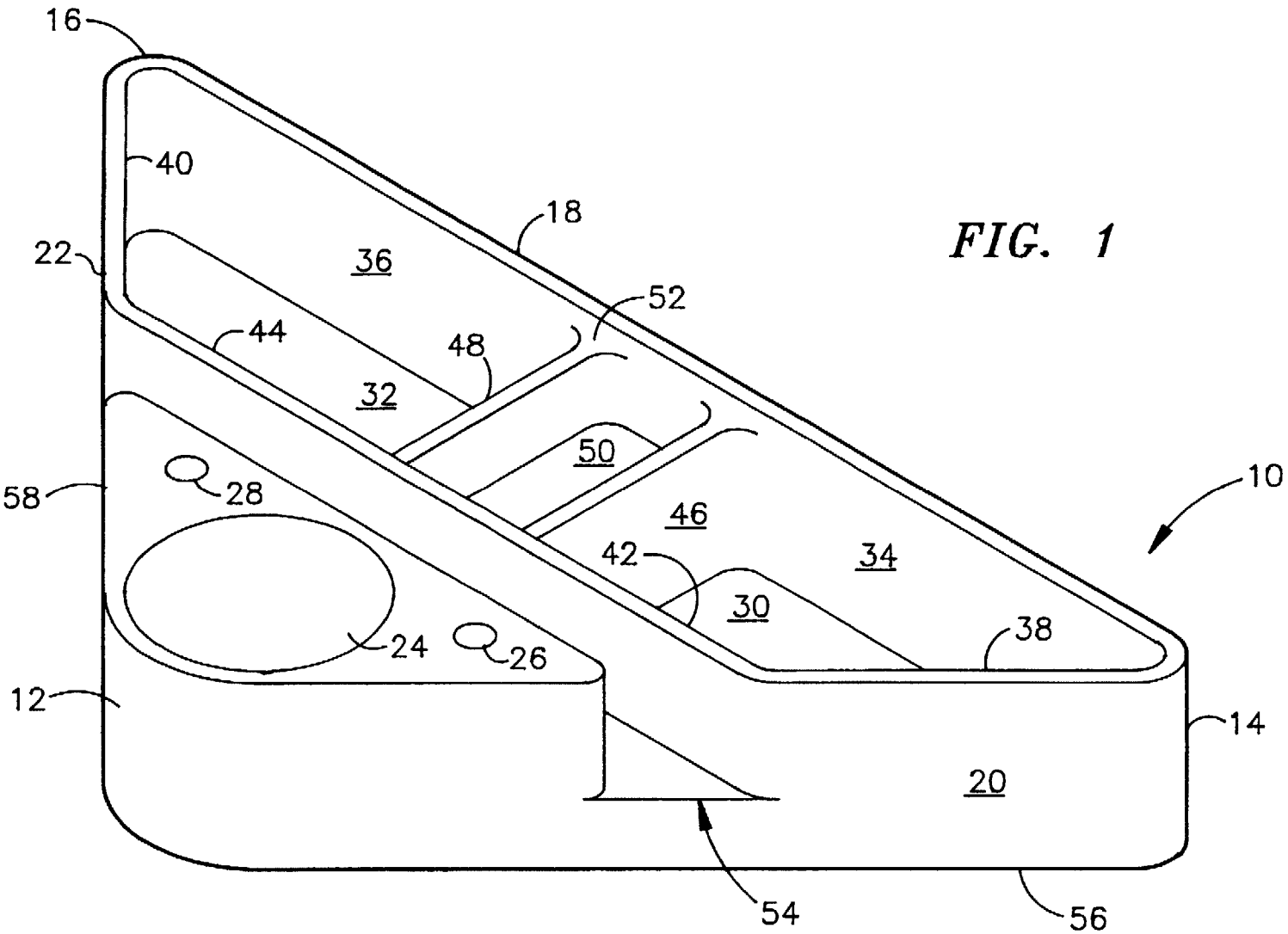
FIG. 1 is a respective view of the hair colorist palette.
Figure 2:
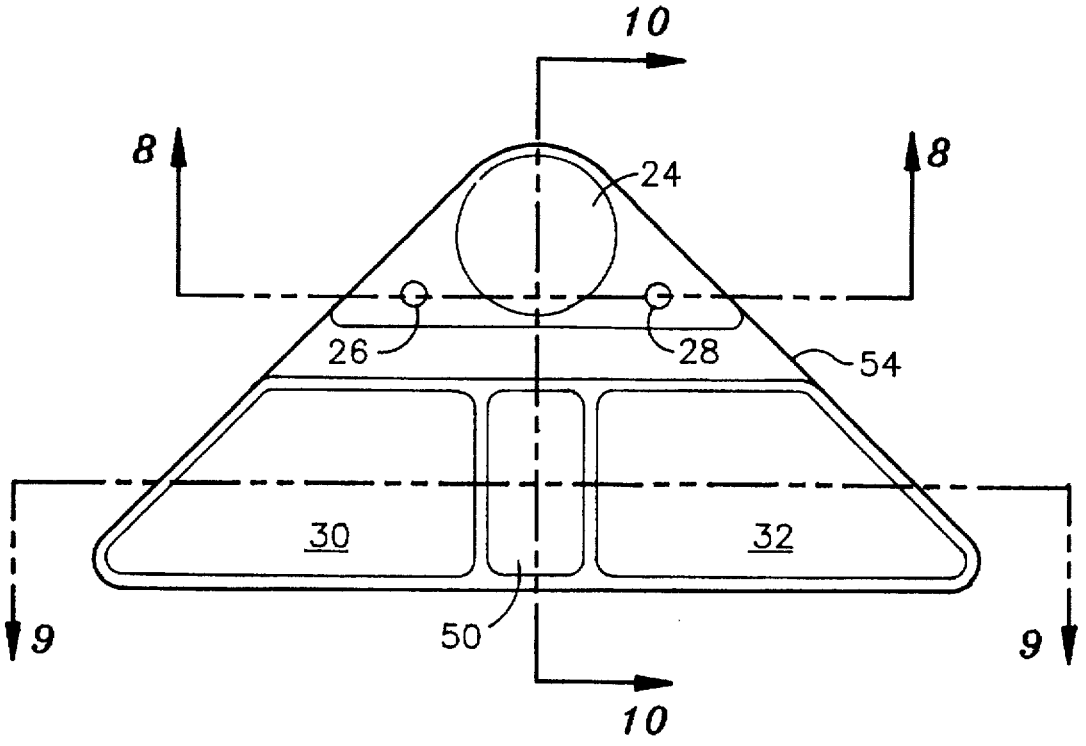
FIG. 2 is a plan view of the hair colorist palette of FIG. 1.
Figure 3:
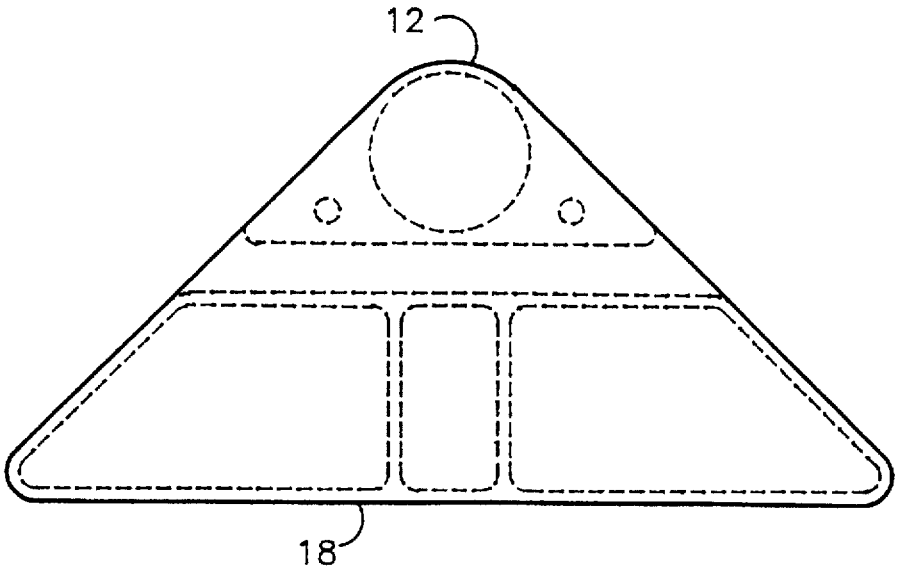
FIG. 3 is a view from the underside of FIG. 2.
Figure 8:
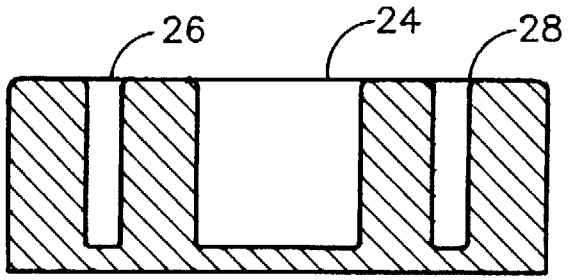
FIG. 8 is a cross-sectional view taken on Section 8—8 of FIG. 2.
Figure 10:
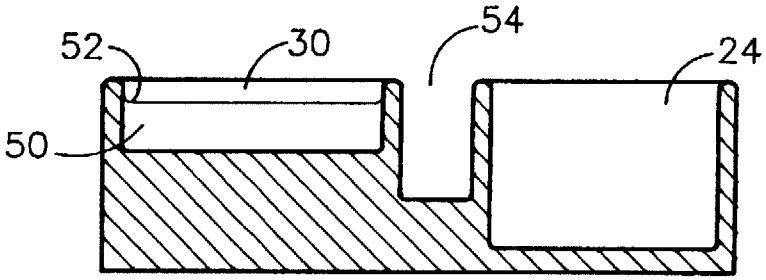
FIG. 10 is a cross-sectional view taken on Section 10—10 of FIG. 2.
Figure 9:
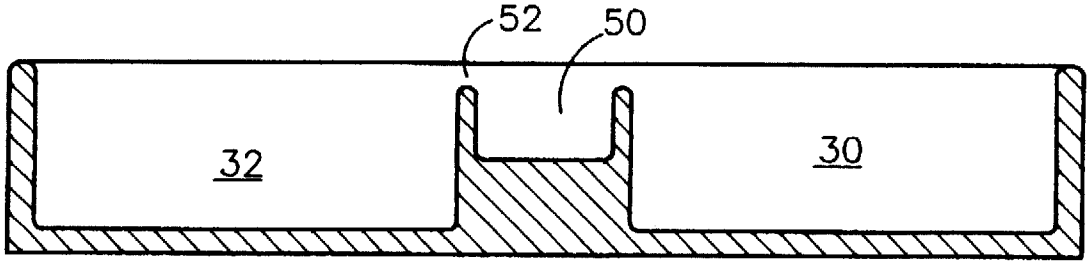
FIG. 9 is a cross-sectional view taken on Section 9—9 of FIG. 2.

With reference to the various figures, the hair colorist palette is in the form of a base member 10 with the overall shape being substantially triangular with the leading edge 12 in the shape an arc of approximately 2⅞ inches in diameter and two trailing edges 14 and 16 having rounded corners. The hair colorist palette 10 is preferably 2 inches tall and has a rear side 18 approximately 13 inches in length. Both the first side 20 and second side 22 are approximately 9 inches in length. The hair colorist palette or base member 10 has five wells and one slot. The round or circular well 24 has preferably a diameter of 2½ inches and is preferably cylindrical with a depth of 1⅜ inches. The round well 24 is usually used to hold a bottle of permanent or semi-permanent hair coloring or extra liquid developer. It is to be noted that the round well 24 is located in the apex of leading edge 12 and its diameter parallels in part the arc of the leading edge 12.

Mounted adjacent each side of round well 24 are two small holes 26 and 28 which are preferably ⅜ inches in diameter and are in the form of cylinders having a depth of approximately 1⅛ inches. These holes are used to hold brushes during the hair coloring process.

The two largest wells are mounted adjacent the rear side 18 and are in the form of two trays having a long side 34 and 36 of preferably 5 inches in length with a depth preferably 1¾ inches deep. Each of the large wells 30 and 32 have an outer side 38 and 40 preferably 3 inches in length and having a preferred depth of 1¾ inches. The ends of the two outer sides 38 and 40 join together with the outer ends of long side 34 and 36 adjacent side edges 14 and 16, respectively. Each of the large wells 30 and 32 have a short side 42 and 44 which parallels the long side 34 and 36, respectively, with a preferable length of 3 inches and a preferable depth of 1¾ inches. The bottom of the large wells 30 and 32 are flat. Large wells 30 and 32 are liquid tight.

The various upright walls of the hair colorist palette or base member 10 including the outer wall and other walls are slightly tapered inward to narrower top portions.

The mixing chamber 50 is located between the large well 30 and large well 32 and is divided from large well 30 and large well 32 by inner wall 46 and inner wall 48, respectively which it shares with large wells 30 and 32. The inside depth of the mixing chamber is approximately ¾ inch. It is to be noted that the top of the mixing chamber is recessed by recess 52 approximately ¼ inch from the top The width of the mixing chamber is approximately 1½ inches and the length approximately 2½ inches. The mixing chamber is liquid tight.

A straight slot 54 bisects the triangular shaped hair colorist palette or base member 10 and runs parallel to rear side 18. The slot is open at both ends and is approximately ¾ inch wide and 1½ inches deep. The slot holds two or more brushes and/or pieces of aluminum foil for use during the coloring process.

The outer edge of the bottom 56 lie in a common plane and form the bottom of the base member or palette 10. While the unit can be solid, it also may be made with a hollow bottom. Parallel to said base member 10 is the top which lies generally in a planar surface spaced approximately 2 inches above the bottom 56.

During use, the hair colorist or hair stylist uses a brush to lift the color from each of the two large wells 30 and 32 into the mixing chamber 50. There the final color for a section of hair is mixed. The brush carries the colorant and/or bleach to a section of hair partitioned by aluminum foil. For highlights or low light areas, predetermined by the colorist, the third color from the bottle can be poured into the mixing chamber. The necessary brushes and foils for carrying out the procedure are readily available either from the two small holes 26 and 28 respectively and/or the slot 54 where additional brushes may be retained and/or foils may be temporarily stored.

The invention has been described herein to provide those skilled in the art with the information needed to apply its features and to utilize such components as are required. However, it is to be understood that the invention can be carried out by specifically different mechanisms without departing from the scope of the invention itself.

I claim:

1. A hair colorist palette comprising:

a triangular shaped base member;

a first corner of said base member;

a rounded opening adjacent to said first corner for accepting a container;

a second corner of said base member;

a first liquid tight well adjacent said second corner;

a third corner of said base member;

a second liquid tight well adjacent said third corner; and a liquid tight mixing chamber located between said first well and said second well which has less depth than the depth of said first and second wells.

2. The hair colorist palette of claim 1 wherein:

a staight slot extends entirely across said base member between said rounded opening on one side and said first and second wells on the opposite side for receiving hair coloring brushes and foils.

3. The hair colorist palette of claim 2 wherein:

at least two small rounded holes are located on said base member adjacent said rounded opening for receiving hair colorist brush handles.

4. The hair colorist palette of claim 3 wherein:

said base member has a bottom whose periphery lies in a first plane and having a substantially planar top which is parallel to said bottom.

* * * * *